US010770217B2

(12) United States Patent
Aarab

(10) Patent No.: US 10,770,217 B2
(45) Date of Patent: Sep. 8, 2020

(54) MOUNTING KIT FOR A THROTTLE, AND THROTTLE

(71) Applicant: Würth Elektronik eiSos GmbH & Co. KG, Waldenburg (DE)

(72) Inventor: Hassan Aarab, Flörsheim am Main (DE)

(73) Assignee: Würth Elektronik eiSos GmbH & Co. KG, Waldenburg (DE)

( * ) Notice: Subject to any disclaimer, the term of this patent is extended or adjusted under 35 U.S.C. 154(b) by 261 days.

(21) Appl. No.: 15/607,884

(22) Filed: May 30, 2017

(65) Prior Publication Data

US 2017/0365390 A1 Dec. 21, 2017

(30) Foreign Application Priority Data

Jun. 1, 2016 (DE) ..... 10 2016 209 613

(51) Int. Cl.

| | |
|---|---|
| ***H01F 27/06*** | (2006.01) |
| ***H01F 27/28*** | (2006.01) |
| ***H01F 17/06*** | (2006.01) |
| ***H01F 27/32*** | (2006.01) |
| *H01F 5/04* | (2006.01) |

(52) U.S. Cl.

CPC ..... *H01F 27/06* (2013.01); *H01F 17/06* (2013.01); *H01F 17/062* (2013.01); *H01F 27/28* (2013.01); *H01F 27/2823* (2013.01); *H01F 27/2895* (2013.01); *H01F 27/324* (2013.01); *H01F 2005/046* (2013.01)

(58) Field of Classification Search

USPC ..... 336/65, 60, 185, 199

See application file for complete search history.

(56) References Cited

U.S. PATENT DOCUMENTS

| | | | | |
|---|---|---|---|---|
| 6,690,257 | B2 * | 2/2004 | Kobayashi | H01F 17/062 336/192 |
| 6,885,269 | B2 * | 4/2005 | Miettinen | H01F 17/062 336/229 |
| 7,280,027 | B2 | 10/2007 | Feth et al. | |
| 7,479,865 | B2 | 1/2009 | Feist et al. | |
| 2011/0001590 | A1 * | 1/2011 | Wu | H01F 17/062 335/219 |
| 2011/0116197 | A1 * | 5/2011 | Zylstra | G01R 15/183 361/42 |

(Continued)

FOREIGN PATENT DOCUMENTS

| | | |
|---|---|---|
| CN | 201796075 | 4/2011 |
| DE | 4239818 A1 | 6/1994 |

(Continued)

OTHER PUBLICATIONS

English translation of Chinese Office Action for corresponding application No. 201710403777.6 dated Apr. 12, 2019 (15 pages).

*Primary Examiner* — Elvin G Enad
*Assistant Examiner* — Kazi S Hossain
(74) *Attorney, Agent, or Firm* — Boyle Fredrickson S.C.

(57) ABSTRACT

Mounting kit for a throttle with a toroidal core, wherein an insulating element which passes through the opening in the toroidal core is provided. The mounting kit includes a first half shell and a second half shell for accommodating the toroidal core, a baseplate, and a latching means and/or guide means to connect the first half shell, the second half shell, the insulating element and the baseplate to one another.

16 Claims, 9 Drawing Sheets

(56) References Cited

U.S. PATENT DOCUMENTS

| | | | | |
|---|---|---|---|---|
| 2015/0228401 | A1* | 8/2015 | Ratz | H01F 27/324<br>336/92 |
| 2015/0287521 | A1* | 10/2015 | Furukawa | H01F 27/02<br>336/65 |

FOREIGN PATENT DOCUMENTS

| | | | |
|---|---|---|---|
| DE | 694 07 728 | T2 | 4/1998 |
| DE | 10 2006 026 364 | A1 | 8/2007 |
| DE | 10 2007 060 556 | A1 | 6/2009 |
| EP | 0 264 840 | A2 | 4/1988 |
| JP | 587627 | Y2 | 2/1983 |
| JP | 0611316 | U | 2/1994 |

* cited by examiner

MOUNTING KIT FOR A THROTTLE, AND THROTTLE

FIELD OF THE INVENTION

The invention relates to a mounting kit for a throttle with a toroidal core, wherein an insulating element which passes through the opening in the toroidal core is provided. The invention also relates to a throttle with a mounting kit according to the invention.

BACKGROUND

German laid-open application DE 10 2007 060 556 A1 discloses a transmission element with a toroidal core and three windings on the toroidal core. The toroidal core is arranged in a mounting kit having two half shells. The windings are wound onto the half shells. A covering hood is provided which completely covers the completed transmitter. The lower half shell is provided with securing pins which protrude towards the lower side of the throttle.

German laid-open application DE 103 08 010 A1 discloses a mounting kit for a throttle with, a toroidal core, wherein an insulating element which passes through the opening in the toroidal core is provided. The insulating element has three webs spaced apart from one another uniformly in the circumferential direction. The insulating element is provided for separating the windings on the toroidal core from one another.

SUMMARY

The intention of the invention is to provide a mounting kit for a throttle with a toroidal, core, the mounting kit facilitating the mounting of a throttle.

For this purpose, according to the invention, a mounting kit with the features of Claim 1 and a throttle with the features of Claim 15 are provided. Advantageous developments of the inventions are cited in the dependent claims.

The mounting kit according to the invention for a throttle with a toroidal core has an insulating element which passes through the opening in the toroidal core, wherein the mounting kit has a first half shell and a second half shell for accommodating the toroidal core, wherein a baseplate is provided, and wherein latching means and/or guide means are provided in order to connect the first half shell, the second half shell, the insulating element and the baseplate to one another. By the individual components of the mounting kit being connected by means of latching means and/or guide means, the individual components are automatically assigned to one another in a spatially correct manner when assembling the mounting kit. As a result, the throttle can be mounted more rapidly and with greater precision. In particular, provision can be made to design the guide means and latching means in such a manner that the throttle can be mounted without tools. For example, the mounting kit can also be provided for a fully automated mounting of the throttle. The first, half shell, the second, half shell, the insulating element and the baseplate are designed as forming separate parts. The baseplate is used to fix a throttle e.g. to a printed circuit board.

In a development of the invention, first latching means and/or guide means are provided for connecting the two half shells.

The two half shells can thereby be automatically connected in the correct position.

In a development of the invention, the first latching means and/or guide means have at least one first projection and two second projections, wherein, in the latched state, the first projection is accommodated at least in sections between the two second projections.

By means of such a design of the first latching means and/or guide means, an aligning function in the circumferential direction can be obtained.

In a development of the invention, second latching means and/or guide means are provided for connecting the first half shell to the baseplate.

The first half shell can thereby be latched onto the baseplate in the correct position. The baseplate can then be fastened, for example, to a printed circuit board or to another component using simple means. In an advantageous manner, combined latching and guide means are provided which firstly align the first half shell or the substantially completely mounted throttle relative to the baseplate in the circumferential direction and at the same time centre the throttle relative to the baseplate and also hold said throttle on the baseplate.

In a development of the invention, the second latching means and/or guide means have at least three projections which emerge from the baseplate and at the free ends of which latching lugs are arranged.

By means of three projections which are in particular spaced apart uniformly from one another in the circumferential direction, centering and simultaneous alignment in the circumferential direction can foe achieved.

In a development of the invention, the two half shells form a torus-shaped holder in the assembled state, wherein the projections extend into a through opening in the torus-shaped holder and lie against a wall forming the through opening in the torus-shaped holder.

The projections can thereby be accommodated in a space-saving manner and at the same time centre the torus-shaped holder and secure said holder on the baseplate.

In a development of the invention, third latching means and/or guide means are provided for connecting the insulating element to the baseplate.

With latching means and/or guide means, the insulating element can be aligned and at the same time held during the connection to the baseplate. The insulating element serves for separating the individual windings on the torus-shaped holder.

In a development of the invention, the insulating element has at least three plate-like webs arranged in a star-shaped manner, wherein radially outer edges of the webs are accommodated in guides on the baseplate.

In a development of the invention, the first half shell is provided with three insulating projections which are spaced apart uniformly in the circumferential direction and, in the mounted state, rest on the baseplate.

By means of such insulating projections on the first half shell, a predefined distance between the first half shell or the winding and the baseplate is obtained. The insulating projections separate the windings from one another.

In a development of the invention, the radially inner sides of the projections emerging from the baseplate are provided with guide grooves for accommodating the radially outer edges of the webs.

In a development of the invention, the first half shell and the second half shell form a torus-shaped holder for a toroidal core, and the insulating element and the holder are provided with fourth latching means and/or guide means which fit together.

In a development of the invention, the second half shell is provided with guide grooves for accommodating radially outer edges of the webs of the insulating element.

In a development of the invention, in the mounted state, the guide grooves of the second half shell are arranged in in each case one radial plane with the guide grooves of the projections of the baseplate.

In a development of the invention, the baseplate, the two half shells and the insulating element are formed as plastics parts, in particular injection moulded parts, which are in each case formed integrally.

The problem on which the invention is based is also solved by a throttle with a torus-shaped toroidal core, at least one wire winding surrounding the toroidal core in sections, and a mounting kit according to the invention, wherein the toroidal core is accommodated in a torus-shaped holder formed by the two half shells, and the wire winding is fitted onto an outer side of the torus-shaped holder.

In a development of the invention, ends of the wire winding are at least partially guided through through openings in the baseplate.

Further features and advantages of the invention emerge from the claims and the description below of preferred embodiments, of the invention in conjunction with the drawings. Individual features of the different embodiments which are illustrated and described can be combined with one another in any manner without exceeding the scope of the invention.

DETAILED DESCRIPTION

Figure 7:
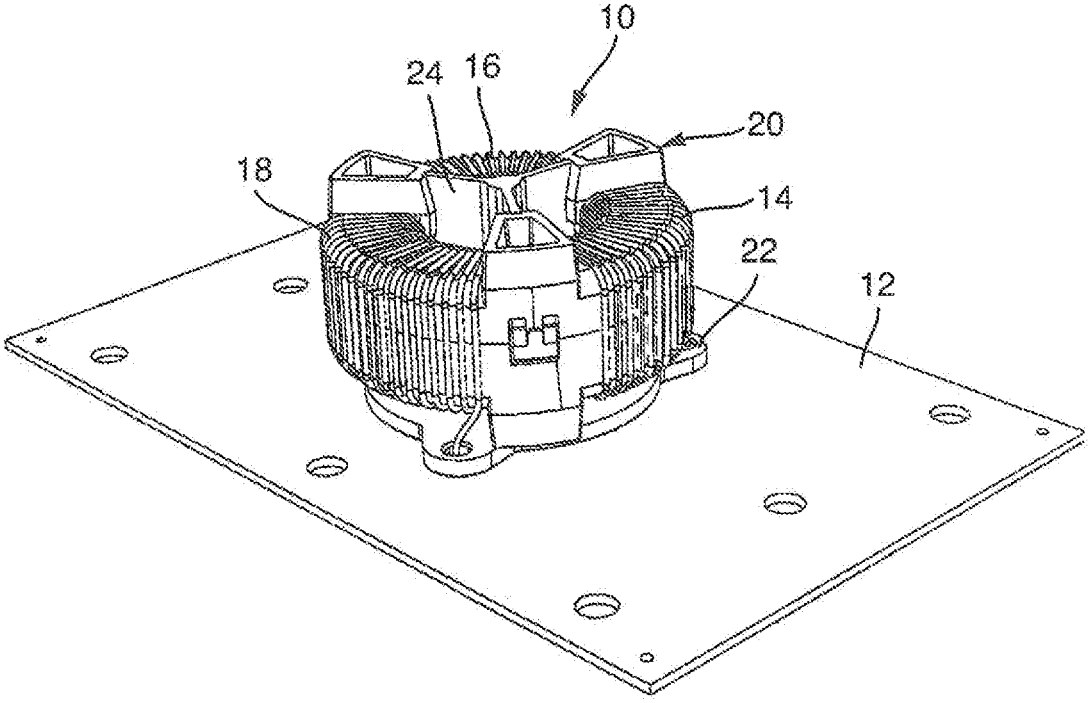
FIG. 7 shows the throttle of FIG. 6 in a view obliquely from above.

The illustration of FIG. 7 shows a throttle 10 according to the invention in the mounted state on a printed circuit board 12 in a view obliquely from above.

The throttle 10 has a total of three windings 14, 16 and 18 which are wound spaced apart from one another onto a torus-shaped holder 20. Connecting wires of the windings are each guided through the printed circuit board 12, wherein this can only partially be seen. The torus-shaped holder 20 is arranged on a baseplate 22. An insulating element 24 which has three webs spaced apart from one another uniformly in the circumferential direction and which separates the windings 14, 16 and 18 from one another is plugged into a through opening in the torus-shaped holder 20.

The holder 20, the baseplate 22 and the insulating element 24 form a mounting kit for the throttle 10 according to the invention, which mounting kit is explained more precisely below.

Figure 1:
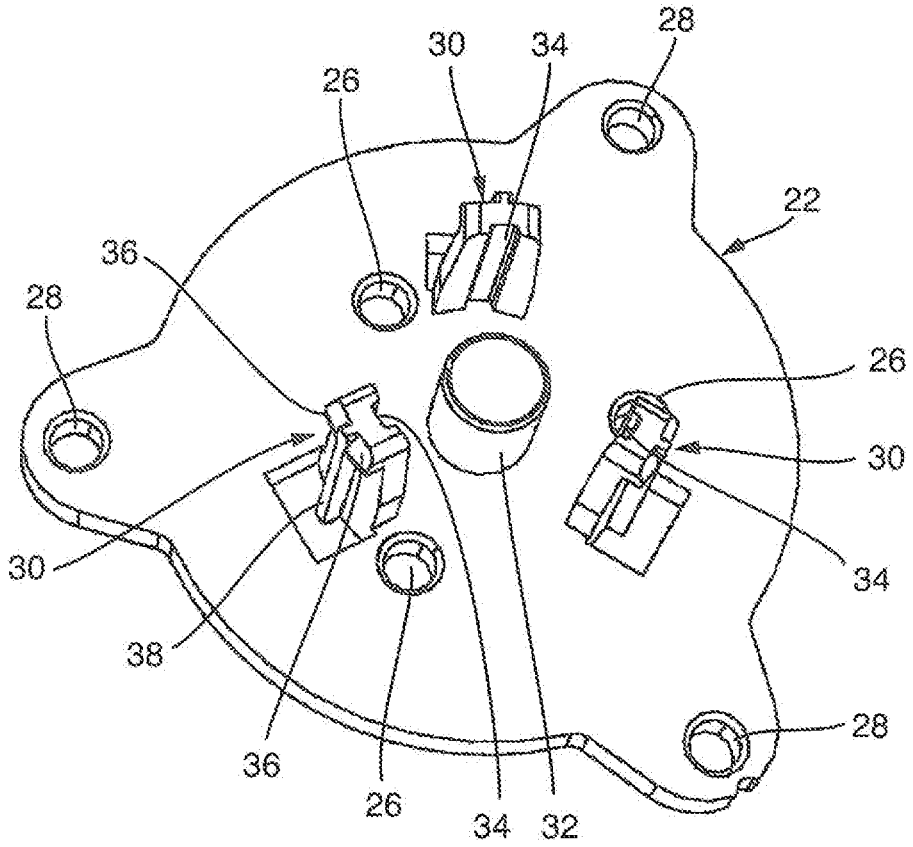
FIG. 1 shows a view of a baseplate of a mounting kit according to the invention obliquely from above.

The illustration of FIG. 1 shows the baseplate 22 in a view obliquely from above. The baseplate has a total of six through openings 26, 28, wherein in each case two through openings 26, 28 are assigned to one of the windings 14, 16 or 18. A winding start of the windings 14, 16, 18 is in each case plugged through one of the radially inner through openings 26 and guided through the baseplate 22. A respective winding end is guided through one of the through openings 28 which are arranged radially outside the through openings 26 and are specifically arranged on radially extending extensions of a circular basic body of the baseplate 22.

The baseplate 22 has three projections 30 which extend upwards from the baseplate 22, towards the observer in the illustration of FIG. 1. The three projections 30 are spaced apart from one another uniformly in the circumferential direction and by an angle of 120°. The projections 30 are arranged around a central dome 32 of the baseplate 22, wherein the dome 32 extends upwards from the basic body of the baseplate 22. The dome 32 serves for the screwing-in of a fastening screw, see FIGS. 8 to 10, in order to fasten the throttle 10 to the baseplate 22, see FIG. 7, and for guiding the insulating element 24.

The projections 30 each have, on their radially inner side, a groove 34 which serves as guide means for the insulating element 24. The groove 34 extends as far as the basic body of the baseplate 22.

On their radially outer side, the projections 30 are each provided with latching lugs 36. The latching lugs can also be replaced by differently designed latching means. Each projection 30 has, on its radially outer side, two latching lugs 36 and, between the latching lugs, a guide web 38 which runs perpendicularly to the basic body of the baseplate 22. By means of the projections 30 and in particular by means of the latching lugs 36 and the guide webs 38, a first half shell is anchored on the baseplate 22.

Figure 2:
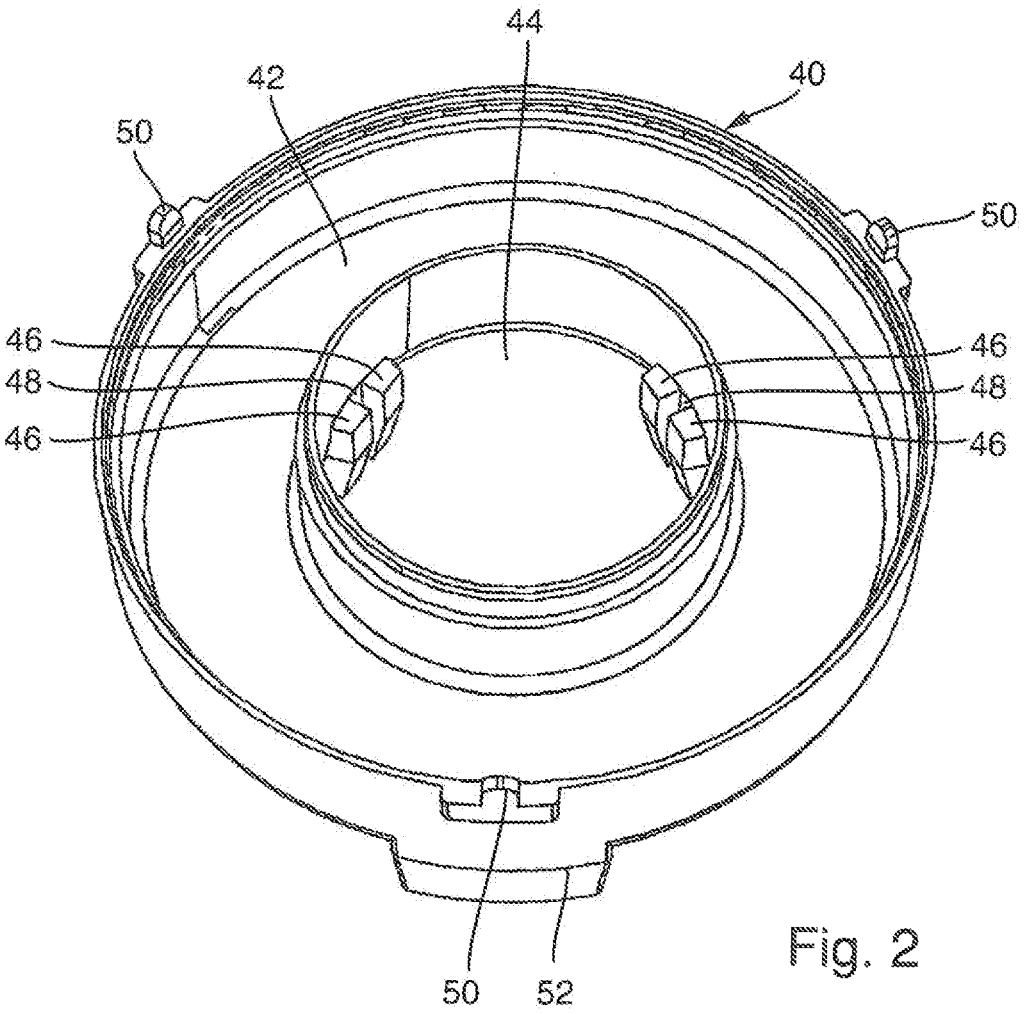
FIG. 2 shows a first half shell of the mounting kit according to the invention obliquely from above.

Said first half shell 40 is illustrated obliquely from above in FIG. 2. The first half shell 40 forms a lower portion of a torus-shaped interior space 42 which is provided for accommodating a toroidal core of the throttle. Such a toroidal core is composed, for example, of ferrite material. The toroidal core can be placed into the first half shell 40 in a simple manner and is thereby already correctly positioned.

The first half shell has three pairs of guide webs 46 in the region of the wall of its through opening 44, wherein two guide webs 46 belonging to a pair form a groove 48 between them. Said groove 48 is provided for accommodating the guide webs 38 on the projections 30 of the baseplate 22, see FIG. 1. An upper end of the guide webs 46 in FIG. 2 serves as a stop for the latching lugs 36 on the projections 30. When the first half shell 40 is pushed onto the projections 30, the projections 30 are first of all slightly bent radially inwards until the latching lugs 36 snap over the upper ends of the guide webs 46 in FIG. 2 and thereby reliably secure the first half shell 40 on the baseplate 22. By means of the guide webs 38 which engage in the grooves 48, after the latching the first half shell is also secured in the circumferential direction in the designated position on the baseplate 22.

As can be seen in FIG. 1, the upper sides of the latching lugs 36 are bevelled. This facilitates the placing on of the guide webs 46 of the first half shell 40, and it is also made easier for the projections 30 to be deflected radially inwards when the first half shell 40 is pushed on in the direction of the basic body of the baseplate 22.

Furthermore, the first half shell 40 is provided on its outer side with three projections 50 which are spaced apart from one another uniformly in the circumferential direction. These projections 50 are provided for engaging between in each case two projections 62 of a second half shell 60, see FIG. 4.

Furthermore, the first half shell 40 is provided on its lower side with three insulating projections 52 which are spaced apart from one another uniformly in the circumferential direction and of which only one can be seen in FIG. 2. In the mounted, state, the insulating projections 52 rest on the baseplate 22 and thereby keep the first half shell 40 at a predefined distance relative to the baseplate 22. The insulating projections 52 also separate the windings 14, 16, 18 from one another, see FIG. 7.

Figure 3:
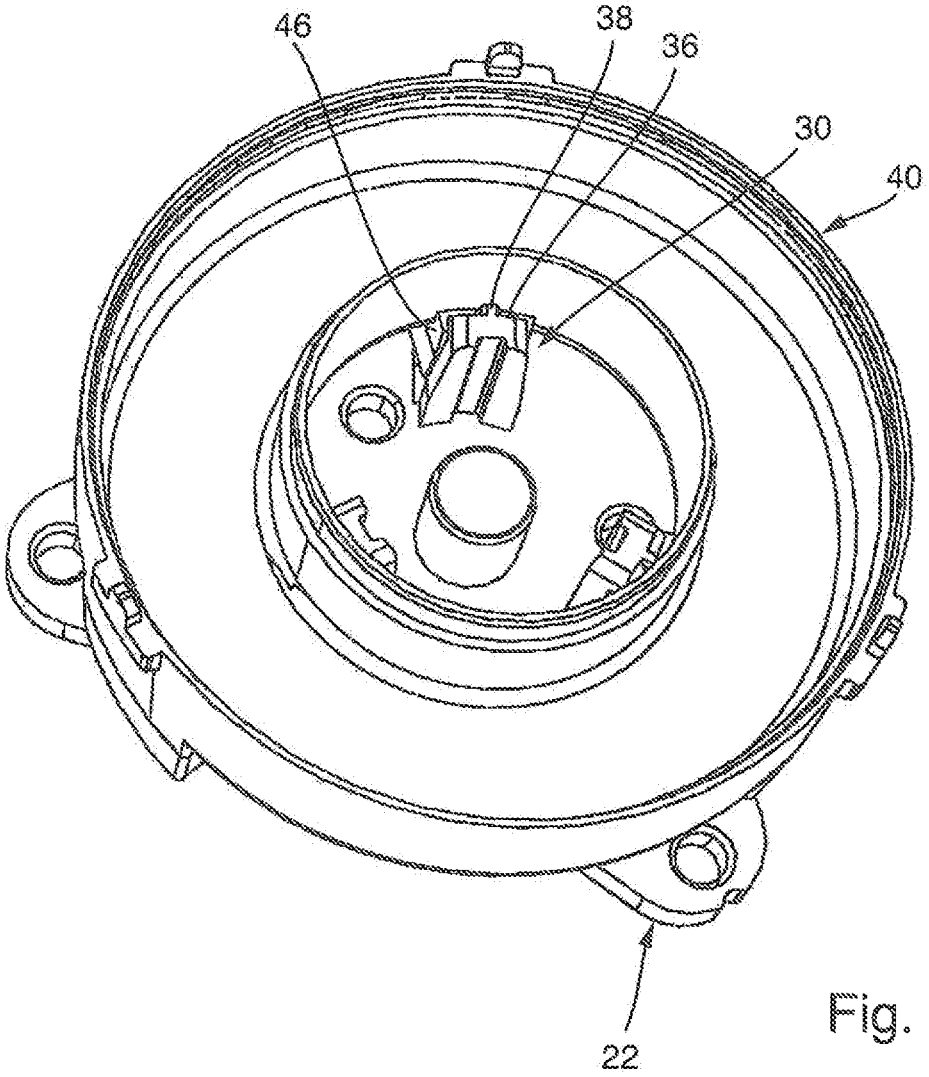
FIG. 3 shows the baseplate of FIG. 1 and the first half shell of FIG. 2 in the assembled state in a view obliquely from above.

FIG. 3 shows the first half shell 40 and the baseplate 22 in the mounted state. It can be seen that the latching lugs 36 of the projections 30 on the baseplate 22 are now snapped over the upper ends of the guide webs 46 on the first half shell 40. The first half shell 40 is thereby held fixedly on the baseplate 22. As has been explained, the guide webs 38 on the projections 30 ensure that the first half shell 40 is also placed in the circumferential direction in the designated position on the baseplate 22.

Figure 4:
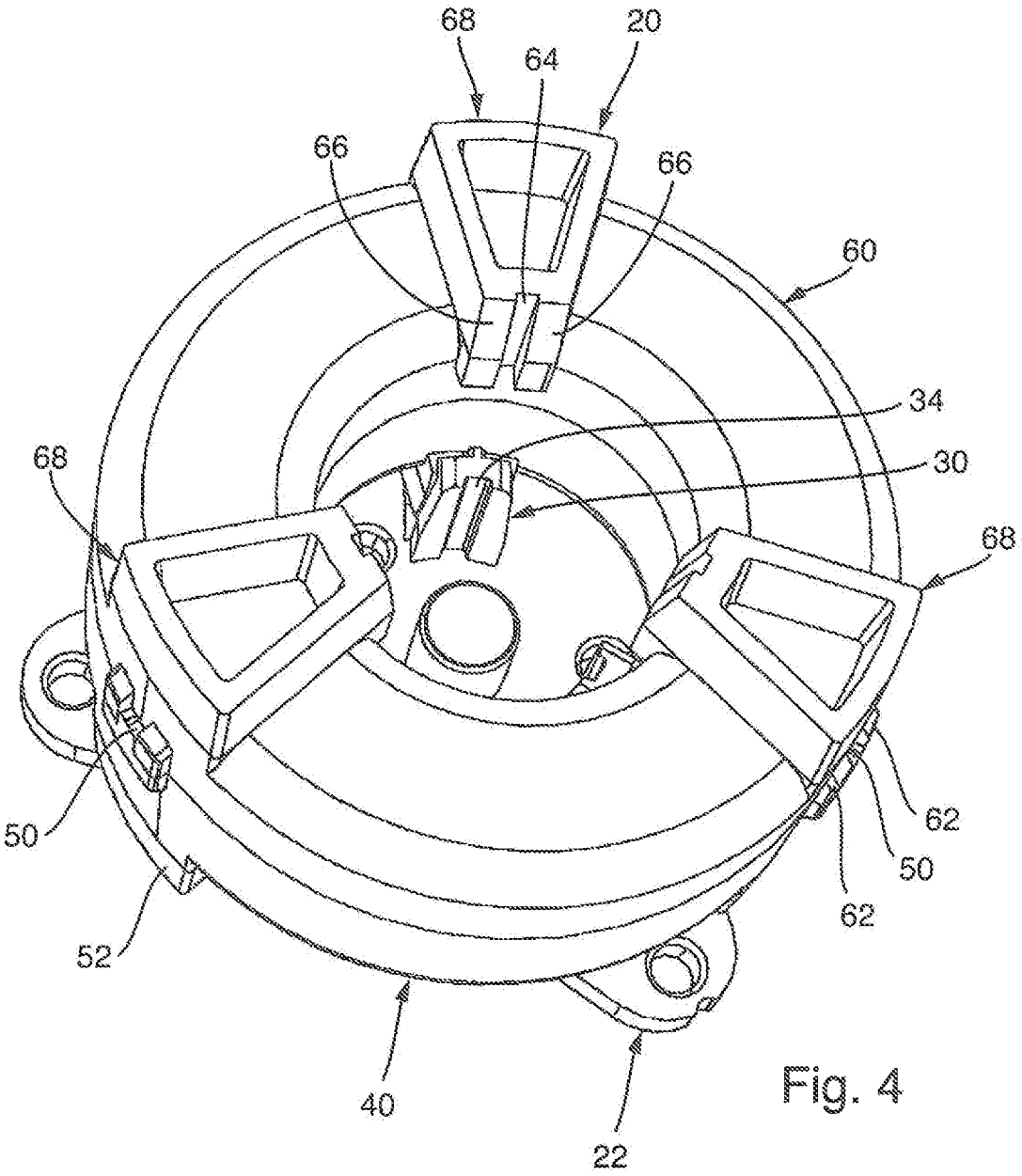
FIG. 4 shows the baseplate, the first half shell and a second half shell of the mounting kit according to the invention in the assembled state in a view obliquely from above.

The illustration of FIG. 4 shows a second half shell 60 in the mounted state on the first half shell 40 and the baseplate 22. The second half shell 60 is placed onto the first half shell 40 in such a manner that the projections 50 of the first half shell 40 are each accommodated between two projections 62, protruding in the radial direction, on the second half shell 60. The second half shell 60 is thereby correctly positioned in the circumferential direction relative to the first half shell 40.

The two half shells 40, 60 thereby form the torus-shaped holder 20, see FIG. 7. A toroidal core of the throttle can be placed into the torus-shaped interior space of the holder 20, and the windings 14, 16, 18 can be placed onto the torus-shaped holder 20. During the mounting of the throttle 10 according to the invention of FIG. 7, the toroidal core is expediently first of all placed into the interior space of the first half shell 40. After the second half shell 60 is placed, onto the first half shell 40, the holder 20 is completed and can now be provided with the windings 14, 16, 18. Only when the holder 20 is provided with the windings 14, 16, 18 is said holder placed onto the baseplate 22.

The upper half shell 60 has, in the radial direction, inwardly open guide grooves 64 which are each formed between two guide webs 66. The grooves 64 and the guide webs 66 are each formed at the radially inner end by insulating projections 68 which are in the shape of circular ring segments and are arranged spaced apart from one another uniformly in the circumferential direction on the upper side of the second half shell 60. One of the windings 14, 16, 18 is in each case arranged between in each case two projections 68, In the mounted state, the insulating projections 68 on the upper half shell 60 are each arranged in alignment with the insulating projections 52 on the lower half shell. The grooves 64 serve for accommodating and guiding webs of the insulating part 24, see FIG. 7.

It can be seen with reference to the illustration of FIG. 4 that, in the mounted state of the second half shell 60, the grooves 64 and the grooves 34 on the inner side of the projections 30 on the baseplate 22 lie in in each case one radial plane. The insulating part 24 can therefore first of all be pushed by its webs into the grooves 64 and then also into the grooves 34 and is thereby automatically correctly positioned with respect to the baseplate 22 and the holder 20.

Figure 5:
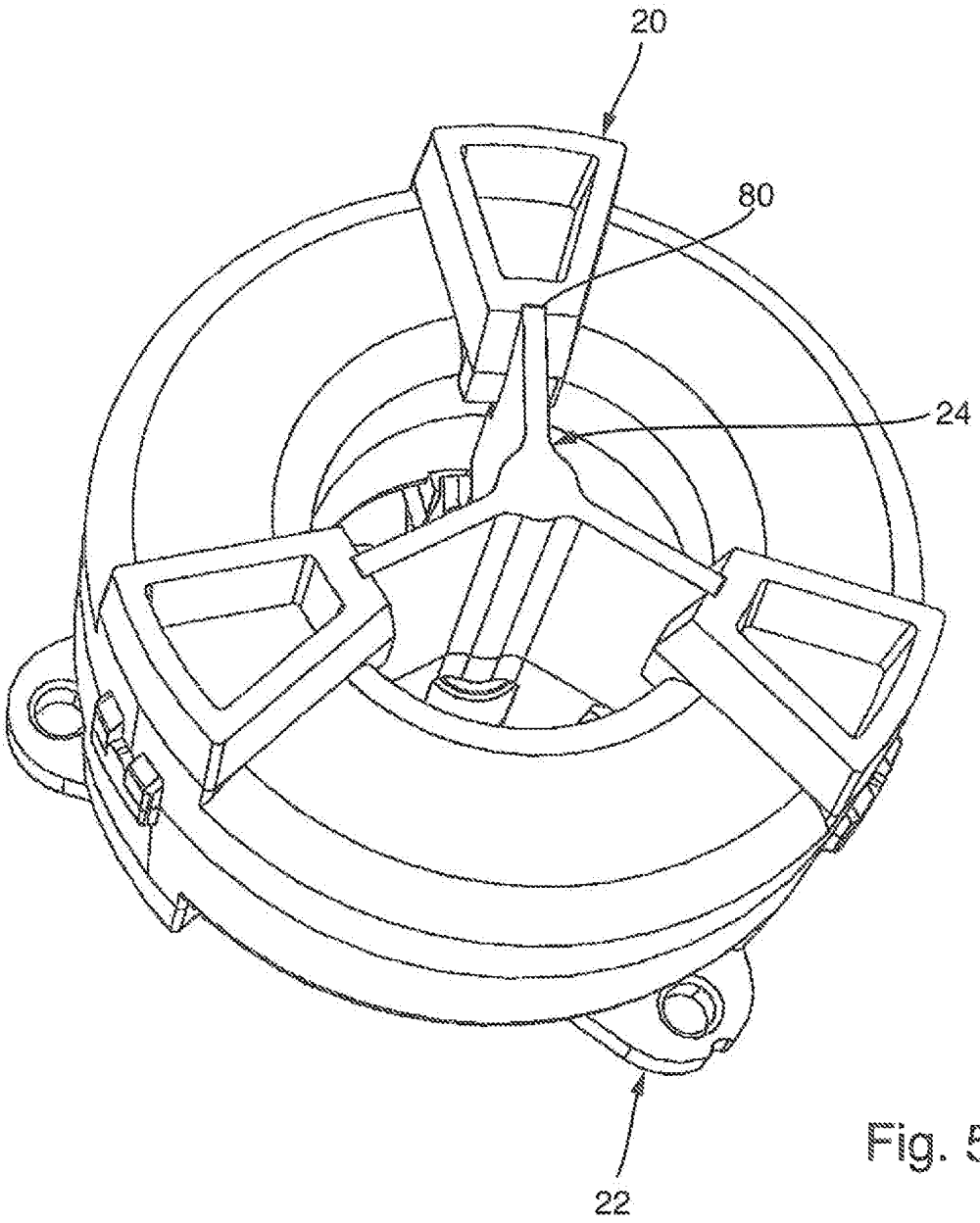
FIG. 5 shows the complete, assembled mounting kit according to the invention in a view obliquely from above.

The illustration of FIG. 5 shows the holder 20 in the mounted state on the baseplate 22, wherein the insulating part 24 has additionally also been pushed into the interior space of the torus-shaped holder 20. The radially outer edges 80 of the webs of the insulating part 24 are now accommodated in the grooves 64 and 34, compare FIG. 4.

Figure 6:
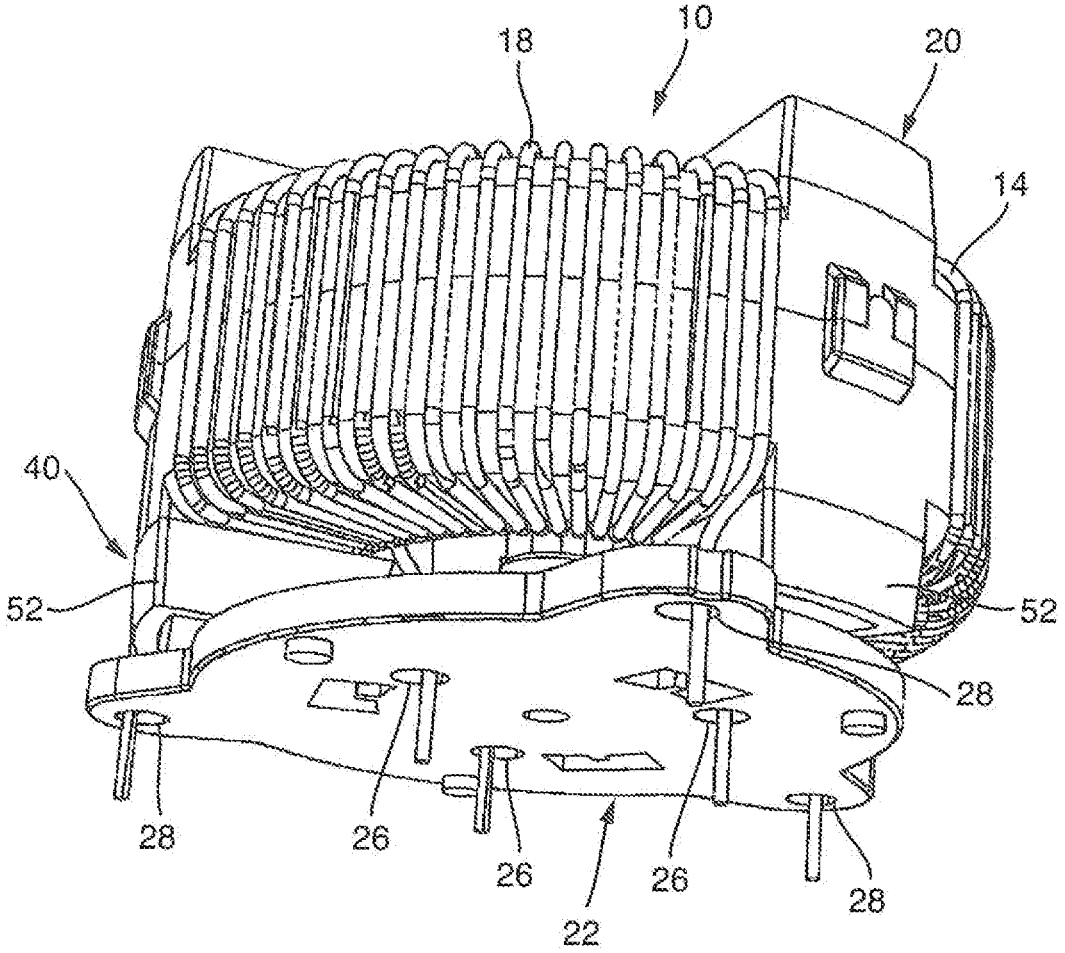
FIG. 6 shows a throttle constructed with the mounting kit according to the invention in a view obliquely from below.

The illustration of FIG. 6 shows the throttle 10 of FIG. 7 in a view obliquely from below. The windings 18 and 14 on the holder 20 can be seen. Furthermore, the through openings 26, 28 in the baseplate 22, through which in each case one winding start or one winding end of the windings 14, 16, 18 is guided, can be seen. The winding starts or winding ends are thereby accessible in a very simple manner from the lower side of the baseplate 22.

It can furthermore be seen in the view of FIG. 6 that the first half shell 40 is provided with the downwardly protruding projections 52 which are in the manner of circular ring segments and firstly separate the windings 14, 16, 18 from one another and secondly ensure a predefined distance of the windings 14, 16, 18 from the upper side of the baseplate 22. The holder 20 or the first half shell 40 rests with the lower side of its projections 52 on the upper side of the baseplate 22.

Figure 8:
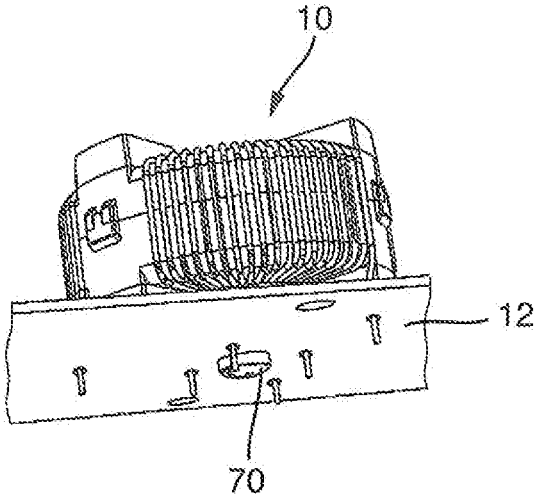
FIG. 8 shows the throttle of FIG. 7 in a view obliquely from below.

The illustration of FIG. 8 shows the throttle 10 of FIGS. 6 and 7 in a view from below. A holding screw 70, not illustrated in FIG. 6, which is screwed through a through opening into a lower side of the dome 32 in the baseplate 22 can be seen in this view. The throttle 10 can thereby be reliably fastened to the printed circuit board 12 with a single screw, namely the holding screw 70.

Figure 9:
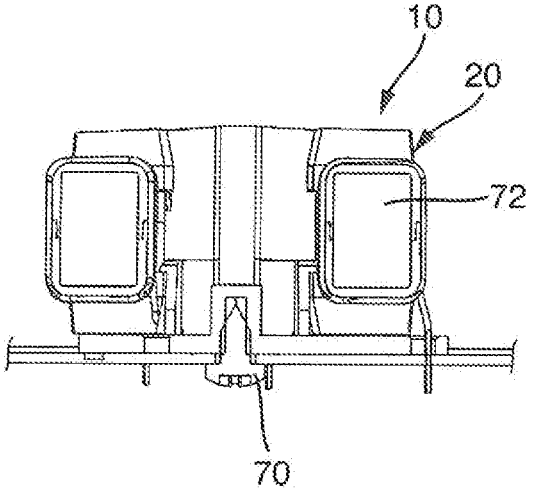
FIG. 9 shows a sectional view of the throttle of FIG. 7.

The illustration of FIG. 9 shows the throttle 10 of FIG. 8 in the sectioned state. A toroidal core 72 arranged in the interior space of the holder 20 can be seen in this view.

Figure 10:
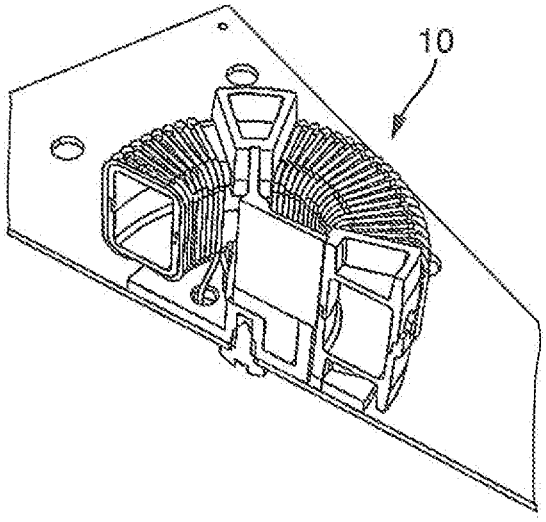
FIG. 10 shows the sectioned throttle of FIG. 9 in a view obliquely from above.

The illustration of FIG. 10 shows the sectioned throttle 10 of FIG. 9 in a view obliquely from above.

Figure 11:
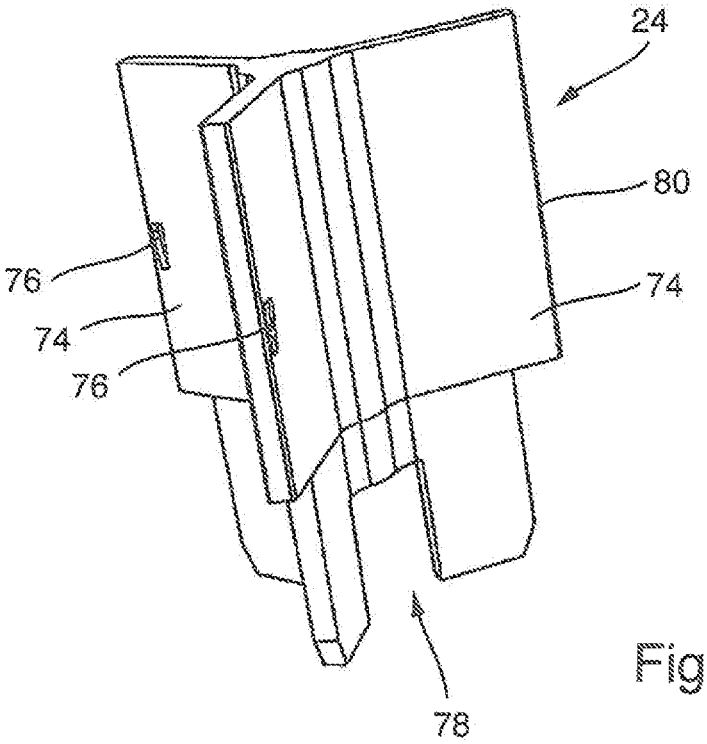
FIG. 11 shows the insulating element of the mounting kit according to the invention in a view obliquely from above.

FIG. 11 shows the insulating element 24 in a view obliquely from above. The three webs 74 which extend outward in the radial direction and are spaced apart from one another uniformly by 120° in the circumferential direction can be seen. The webs 74 are provided in the region of their side surfaces which are adjacent to the outer surfaces with wedge-shaped latching hooks 76 which ensure a play-free fit of the webs 74 in the grooves 64, see FIG. 4. It can also be seen that the webs 74 are formed shorter in a lower region in the radial direction. The webs 74 are thereby adapted to the position of the grooves 34 in the projections 30 of the baseplate 22, see FIG. 4. At the lower end of the insulating element 24, the webs 74 have a central recess 78. The dome 32 of the baseplate 22 is accommodated in said recess. The insulating element 24 and therefore also the holder 20 are thereby further secured and centred.

Figure 12:
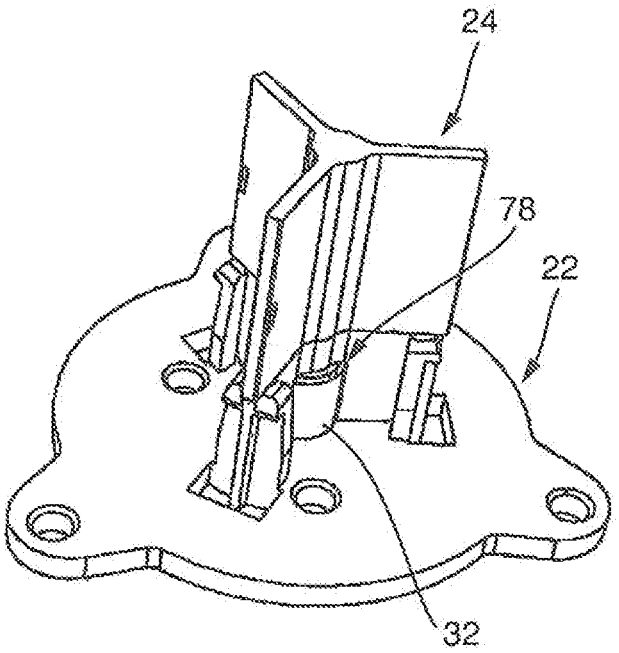
FIG. 12 shows the baseplate of FIG. 1 and the insulating element, of FIG. 11 in the plugged-together state.

The illustration of FIG. 12 shows the insulating element 24 in the mounted state on the baseplate 22. It can be seen how the dome 32 of the baseplate 22 now projects into the central recess 78 of the insulating element 24.

The invention claimed is:

1. Mounting kit for a throttle with a toroidal core, wherein an insulating element passes through an opening in the toroidal core, comprising:

a first half shell and a second half shell for accommodating the toroidal core;

a baseplate; and a latching means and guide means, extending from the baseplate into the opening in the toroidal core, that connects and relatively aligns the first half shell, the second half shell, the insulating element and the baseplate to one another from within an inner radius of the toroidal core, wherein the second latching means and/or guide means have at least three projections which emerge from the baseplate and at the free ends of which latching lugs are arranged.

2. Mounting kit according to claim 1, wherein first latching means and/or guide means are provided for connecting the two half shells.

3. Mounting kit according to claim 1, wherein the first latching means and/or guide means have at least one first projection and two second projections, wherein, in the latched state, the first projection is accommodated at least in sections between the two second projections.

4. Mounting kit according to claim 1, wherein second latching means and/or guide means are provided for connecting the first half shell to the baseplate.

5. Mounting kit according to claim 1, wherein the two half shells form a torus-shaped holder in the assembled state, wherein the projections extend into a through opening in the torus-shaped holder and lie against an interior wall forming the through opening in the torus-shaped holder.

6. Mounting kit for a throttle with a toroidal core, wherein an insulating element passes through an opening in the toroidal core, comprising:

a first half shell and a second half shell for accommodating the toroidal core;

a baseplate; and a latching means and guide means, extending from the baseplate into the opening in the toroidal core, that connects and relatively aligns the first half shell, the second half shell, the insulating element and the baseplate to one another from within an inner radius of the toroidal core, wherein guide means are provided for connecting the insulating element to the baseplate, wherein the insulating element has at least three plate-like webs arranged in a star-shaped manner, wherein radially outer edges of the webs are accommodated in guides on the baseplate.

7. Mounting kit for a throttle with a toroidal core, wherein an insulating element passes through an opening in the toroidal core, comprising:

a first half shell and a second half shell for accommodating the toroidal core;

a baseplate; and a latching means and guide means, having at least three projections extending from the baseplate into the opening in the toroidal core, that connects and relatively aligns the first half shell, the second half shell, the insulating element and the baseplate to one another from within an inner radius of the toroidal core, wherein guide means are provided for connecting the insulating element to the baseplate, and wherein the insulating element has at least three plate-like webs arranged in a star-shaped manner, wherein radially outer edges of the webs are accommodated in guides on the baseplate and the radially inner sides of the projections are provided with guide grooves for accommodating the radially outer edges of the webs.

8. Mounting kit for a throttle with a toroidal core, wherein an insulating element passes through an opening in the toroidal core, comprising:

a first half shell and a second half shell for accommodating the toroidal core;

a baseplate; and a latching means and guide means, extending from the baseplate into the opening in the toroidal core, that connects and relatively aligns the first half shell, the second half shell, the insulating element and the baseplate to one another from within an inner radius of the toroidal core, wherein the first half shell is provided with three insulating projections which are spaced apart uniformly in the circumferential direction and, in the mounted state, rest on the baseplate.

9. Mounting kit for a throttle with a toroidal core, wherein an insulating element passes through an opening in the toroidal core, comprising:

a first half shell and a second half shell for accommodating the toroidal core;

a baseplate; and a latching means and guide means, extending from the baseplate into the opening in the toroidal core, that connects and relatively aligns the first half shell, the second half shell, the insulating element and the baseplate to one another from within an inner radius of the toroidal core, wherein the first half shell and the second half shell form a torus-shaped holder for the toroidal core, and in that the insulating element and the holder are provided with fourth latching means and/or guide means which fit together.

10. Mounting kit according to claim 9, wherein the second half shell is provided with guide grooves for accommodating radially outer edges of the webs of the insulating element.

11. Mounting kit according to claim 8, wherein, in the mounted state, the guide grooves of the second half shell lie in in each case one radial plane with the guide grooves of the projections of the baseplate.

12. Mounting kit according to claim 1, wherein the baseplate, the two half shells and the insulating element are formed as plastics parts, in particular injection moulded parts, which are in each case formed integrally.

13. Throttle with a torus-shaped toroidal core, at least one wire winding surrounding the toroidal core in sections, and a mounting kit according to claim 1, wherein the toroidal core is accommodated in a torus-shaped holder formed by the two half shells, and in that the wire winding is fitted onto an outer side of the torus-shaped holder.

14. Mounting kit according to claim 1, wherein the three latching lugs affix the first half shell to the projections at points along an interior radius of the first half shell.

15. Mounting kit according to claim 1, wherein the at least three projections which emerge from the baseplate further include first groves for receiving the insulating element.

16. Mounting kit according to claim 1, wherein the second half shell includes second groves that align with the first groves of the at least three projections and also receive the insulating element.

* * * * *